United States Patent [19]

Stoll et al.

[11] 4,211,155

[45] Jul. 8, 1980

[54] LABORATORY HOOD

[75] Inventors: Kurt Stoll, Steinfurt; Herbert Hinder, Günterod; Nikolaus Corpus, Schönbach, all of Fed. Rep. of Germany

[73] Assignee: Heinrich Prinkmann Anlagenvernachtung, Dreieich, Fed. Rep. of Germany

[21] Appl. No.: 964,921

[22] Filed: Nov. 30, 1978

[30] Foreign Application Priority Data

Dec. 27, 1977 [DE] Fed. Rep. of Germany ..... 2758348

[51] Int. Cl.[2] ..... F23J 11/00

[52] U.S. Cl. ..... 98/115 LH; 55/DIG. 29; 98/36

[58] Field of Search ..... 98/115 LH, 36; 126/299 D; 118/326, DIG. 7; 55/DIG. 29

[56] References Cited

U.S. PATENT DOCUMENTS

| | | | |
|---|---|---|---|
| 2,649,727 | 8/1953 | Snow et al. | 98/115 LH |
| 3,340,788 | 9/1967 | Landingham et al. | 98/115 LH |
| 3,408,914 | 11/1968 | Bayern | 98/115 LH |
| 3,513,766 | 5/1970 | Ahlrich | 98/115 LH |
| 4,047,519 | 9/1977 | Nett | 126/299 D |

*Primary Examiner*—Ronald C. Capossela
*Attorney, Agent, or Firm*—Karl F. Ross

[57] ABSTRACT

A laboratory hood has a housing that is horizontally elongated and that is provided with an exhaust that withdraws gas from inside the housing through the back wall thereof. A horizontally elongated diffuser chamber of the same length as the housing is subdivided by a horizontal partition into a pair of vertically spaced compartments communicating through a full-length slot that is formed by the partition. An intake blower pressurizes the top compartment through a relatively narrow conduit and a wide conduit whose width is equal to the full length of the chamber and housing extends between the lower compartment and the top wall of the housing so that air fed to the upper compartment can diffuse through the slot and then pass down through the wide conduit to issue as a broad curtain in the hood. The front wall of the conduit is planar to direct a portion of its air straight down and the rear wall of the conduit is downwardly and forwardly convexly curved to direct part of the air backwardly.

8 Claims, 3 Drawing Figures

LABORATORY HOOD

FIELD OF THE INVENTION

The present invention relates to a laboratory hood. More particularly this invention concerns such a hood which is fed with air and from which air is exhausted.

BACKGROUND OF THE INVENTION

A standard laboratory hood has a housing with an open or openable front side and with exhaust openings normally in the back wall which are connected to an exhaust fan for removing undesirable vapors, gases and the like from inside the hood. Thus it is possible for potentially dangerous experiments and tests to be carried out with relative safety.

A disadvantage of this system is that it frequently draws an inordinate amount of the ambient air in the laboratory out. Thus in seasons when the laboratory is heated or air conditioned a considerable waste of energy results. This tendency can be countered by reducing the volumetric throughput of the exhaust blower, with a concomitant decrease in hood efficiency.

It has been suggested to provide an outside-air intake for such a hood, to relieve the problem of robbing the laboratory of its climate-controlled or even filtered air. Such an arrangement has been found inadequate as the flow through the hood is uneven, so that dead corners result which are inadequately ventilated.

OBJECTS OF THE INVENTION

It is therefore an object of the present invention to provide an improved laboratory hood.

Another object is the provision of such a hood which is thoroughly ventilated, yet which does not create undesired drafts in the adjacent areas.

SUMMARY OF THE INVENTION

These objects are attained according to the instant invention in a laboratory hood whose housing has vertically spaced and horizontally elongated top and bottom walls as well as a horizontally elongated upright back wall and an open or openable front side, the latter being joined by relatively short upright side end walls. The top wall is formed with an inlet opening extending generally the full length of the top wall and having a front edge immediately adjacent the front side and a back edge spaced rearwardly therefrom. A wide conduit of a width equal to the length of the top and bottom walls has an outlet end connected to the inlet opening and is supplied with a gas under superatmospheric pressure for introduction of this gas, normally air, into the interior of the housing as a curtain extending the full length thereof. An exhaust fan is provided for sucking gas from this interior, and the capacity or volumetric throughput of the exhaust is somewhat greater than that of the input blower to insure that no undesirable vapors or gases inside the hood can leak out.

With the system according to the instant invention the interior of the hood is effectively swept by air so that no dead corners or pockets result. The air is not taken from inside the laboratory, although a certain amount of laboratory air must inherently be exhausted to completely eliminate the possibility of leakage into the laboratory, but can be drawn in from outside. The use of a wide curtain also allows relatively low velocities to be employed, so that the blowing-out of Bunsen burners or other inadvertent interference with experiments or tests, such as are common with prior-art systems which employ powerful fans that create a strong draft through the hood, is eliminated.

According to further features of the instant invention the air is fed into the housing through a narrow conduit, a diffuser chamber, and the above-mentioned wide conduit. The diffuser chamber is a horizontally elongated box of the same length and positioned above the housing. It is subdivided internally by a horizontal partition plate into an upper compartment and a lower compartment that only communicate through a relatively narrow slot formed between the rear edge of the partition and the rear wall of the diffuser chamber. The flow cross section of this slot is substantially smaller than that of the narrow inlet conduit and also than that of the wide conduit that opens through the top wall into the housing. Thus a blower in the narrow inlet conduit will be able to pressurize the upper compartment completely, from end to end, to insure that the air curtain that issues from the bottom end of the wide conduit has the same pressure and velocity across its entire length.

In accordance with yet another feature of this invention the wide conduit extending from the diffuser chamber to the top wall of the housing of the hood has a generally planar front wall and a quarter-cylindrical downwardly and forwardly convexly curved rear wall that starts at its top end generally parallel to the front conduit wall and terminates generally parallel to the horizontal top wall of the hood housing. Thus the air curtain is given a fan shape that insures that it enters every portion of the interior of the housing. The exhaust openings are provided at the top and bottom of the rear wall so that very efficient aspiration of any gases or vapors in the hood is certain. The upper intake end of the wide conduit is spaced in a horizontal direction perpendicular to the elongation direction of the chamber and housing from the diffuser slot so air flow is as even as possible.

According to another feature of the instant invention the narrow intake conduit is provided with a vent or diffuser that opens forwardly into the laboratory. Thus the device can be used to ventilate this area, and to replace what air is sucked out of the laboratoory through the front of the hood.

SPECIFIC DESCRIPTION

Figure 1:
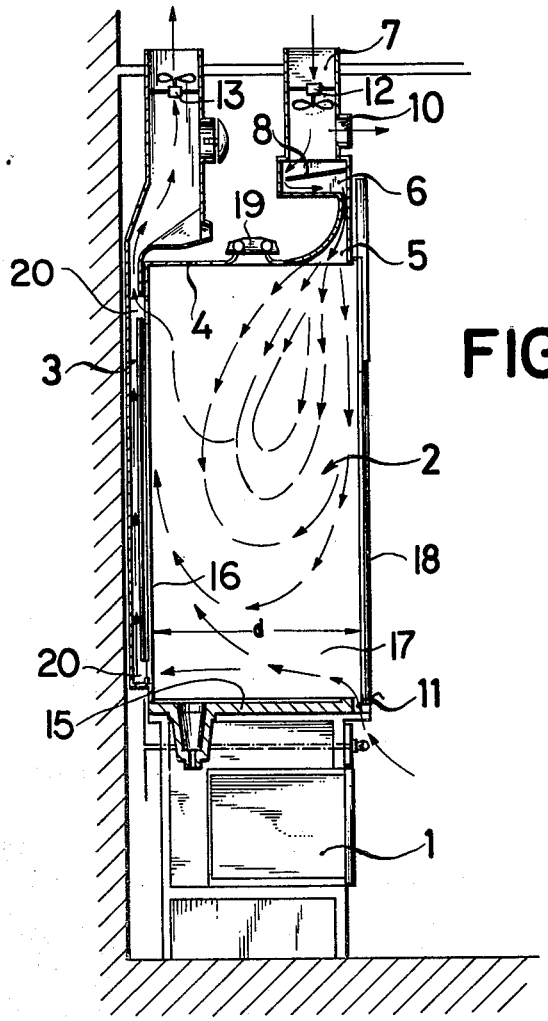
FIG. 1 is a vertical section through the hood according to the instant invention.
Figure 2:
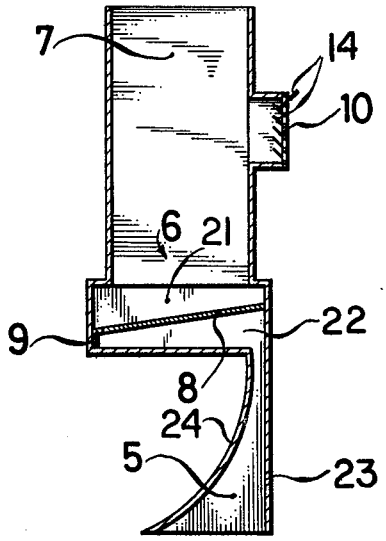
FIG. 2 is a large-scale view of a detail of FIG. 1.
Figure 3:
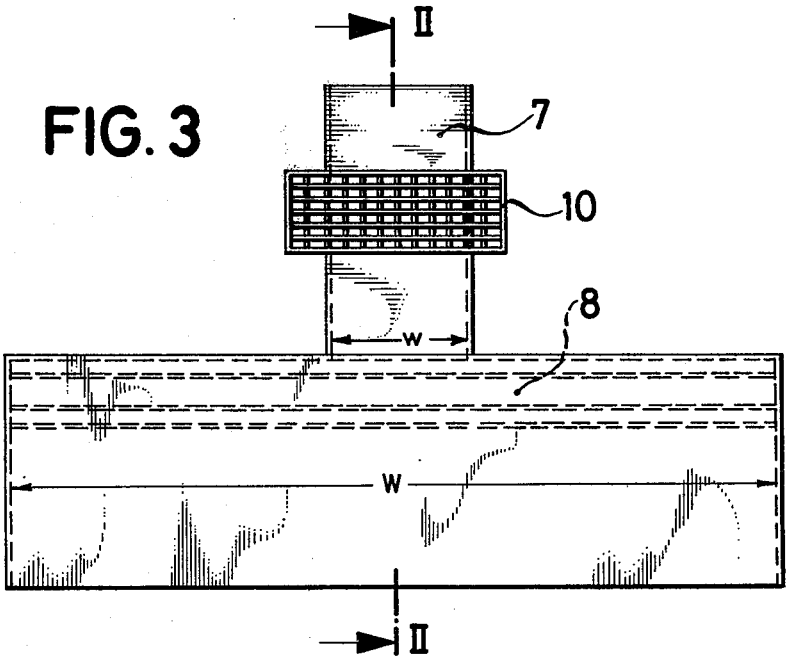
FIG. 3 is a front view of the detail of FIG. 2, line II—II being the section line for FIG. 2.

As shown in FIG. 1 a laboratory table 1 has an upper surface 15 forming the bottom wall of a hood housing 2 having a back wall 16, end walls 17, a front side closable by a liftable panel 18, and a top wall 4 provided with a light 19. The front, back, top, and bottom walls have a width W (see FIG. 3) equal to approximately three times the distance d between the front and back walls.

The back wall 16 is formed at its bottom with exhaust openings 20 and at its top with further exhaust openings 20 communicating with an exhaust conduit 3 extending upwardly and provided with a large-capacity exhaust blower 13.

An intake blower 12 is provided in a relatively narrow conduit 7 having a width w substantially smaller than the width W. This narrow square-section conduit 7 is provided with a forwardly opening diffuser/vent 10 having adjustable vanes 14. At its lower end the conduit 7 opens into the top of a horizontally elongated diffuser chamber 6 extending horizontally the full width W of the hood 2 and provided internally with a partition plate 8 that subdivides its interior into an upper compartment 21 and a lower compartment 22. The plate 8 is inclined somewhat downwardly toward the rear and defines at its rear edge a slot 9 with the chamber 6. The flow cross-section of this slot 9 is smaller than that of the conduit 7.

A conduit 5 having the width W opens upwardly at the extreme front end of the compartment 22 and downwardly into the hood 2 immediately adjacent the front side 18 thereof. This conduit 5 has a planar front wall 23 and a quarter-cylindrical rear wall 24. Its flow cross section at its smallest portion is greater than that of the slot 9.

In operation the small-capacity blower 12 and large-capacity blower 13 are operated simultaneously. This draws ambient outside air in through the conduit 7, allowing some of it to escape into the laboratory through the vent 10. The upper compartment 21 is pressurized so that air under pressure passes through the slot 9 into the lower compartment 22 to pressurize it evenly along its entire length. This pressurized air then flows down through the wide conduit 5 and exits as a broad fan-shaped curtain into the hood 2. The curved rear conduit wall 24 insures that some of the air is directed backwardly, while some is directed straight down by the planar front wall 23.

Meanwhile the large-capacity fan 13 is sucking in air through the openings 20 and 21. As the capacity of the fan 12 is slightly smaller than that of the fan 13, some further air will be drawn in under the front wall 18 at 11.

Thus the entire interior of the hood 2 is effectively ventilated. Little ambient air is drawn into the hood, and the flow is so efficient that high velocities of air flow through the hood need not be employed. What little air is drawn into the hood is replaced through the diffuser 10.

We claim:

1. A laboratory hood comprising:
an at least partially closed housing having
an elongated interior,
an elongated top housing wall formed with an inlet opening extending generally the full length of said top wall,
an upright back housing wall substantially of said length, and
an openable front wall also substantially of said length, said inlet opening having a front edge immediately adjacent said front side and a back edge spaced backwardly therefrom;
a conduit having
a width generally equal to said length,
an outlet end connected to said inlet opening,
a generally planar front conduit wall terminating at said front edge, and
a forwardly and downwardly convexly curved back conduit wall curving from its upper end generally parallel to said front conduit wall to its bottom end generally parallel to said top housing wall at said back edge; and
means for feeding a gas under superatmospheric pressure to said conduit for introduction of said gas into said interior as a curtain extending said full length and flowing generally parallel to said front and top housing walls at said inlet mouth.

2. A laboratory hood comprising:
an at least partially closed housing having an elongated interior and an elongated top housing wall formed with an inlet opening extending generally the full length of said top wall;
a conduit having a width generally equal to said length and having an outlet end connected to said inlet opening;
an elongated chamber substantially of said length above said housing and having an elongated outlet opening substantially of said length connected to said conduit, and a partition extending substantially said length inside said chamber and subdividing same into an upper compartment and a lower compartment, said partition defining with said chamber a narrow slot extending substantially said length, said compartments communicating with each other only through said slot; and
means for feeding a gas under superatmospheric pressure to said upper compartment and through said slot to said lower compartment and said conduit for introduction of said gas into said interior as a curtain extending said full length.

3. The hood defined in claim 2 wherein said slot is spaced in a direction perpendicular to said lengths from said outlet opening.

4. The hood defined in claim 2, further comprising a relatively narrow inlet conduit connected between said upper compartment and said feed means, and an adjustable vent connected to said inlet conduit and opening externally of said housing.

5. A laboratory hood comprising:
a housing having vertically spaced top and bottom walls of a predetermined relatively large horizontal width, a pair of oppositely relatively short side walls extending vertically between said top and bottom walls, a back wall of said large width, and an open front side;
exhaust means for withdrawing gas from the interior of said housing through said back wall;
a horizontally elongated chamber generally of said large width above said top wall;
a partition extending the full length inside said chamber and subdividing same into an upper compartment and a lower compartment, said partition defining with said chamber a narrow slot extending the full length of said chamber, said compartments communicating with each other only through said slot;
a wide conduit of a horizontal width substantially equal to said large width extending between and opening into said lower compartment and into said interior at said top wall;
a narrow conduit of a horizontal width substantially smaller than said large width and opening into said upper compartment; and
blower means for feeding air through said narrow conduit into said upper compartment under superatmospheric pressure, whereby the air fed in passes through said slot into said lower compartment and thence through said side conduit into said interior where it is aspirated by said exhaust means.

6. The laboratory hood defined in claim 5 wherein said top wall is formed with an inlet opening extending generally the full length of said top wall and having a front edge immediately adjacent said front side and a rear edge, said wide conduit having a generally planar front conduit wall terminating at said front edge and a forwardly and downwardly convexly curved back conduit wall.

7. The laboratory hood defined in claim 6 wherein said slot has a flow cross section substantially smaller than that of said narrow conduit and of said wide conduit.

8. The laboratory hood defined in claim 5 wherein said exhaust means operates at a substantially greater volumetric throughput than said blower means.

* * * * *